US007854373B2

(12) United States Patent
Chen

(10) Patent No.: US 7,854,373 B2
(45) Date of Patent: Dec. 21, 2010

(54) PACKING BOX FOR HEADPHONES

(75) Inventor: Hsien-Ta Chen, Taoyuan (TW)

(73) Assignee: OBO PRO.2 Inc., Taoyuan (TW)

( * ) Notice: Subject to any disclaimer, the term of this patent is extended or adjusted under 35 U.S.C. 154(b) by 527 days.

(21) Appl. No.: 11/877,524

(22) Filed: Oct. 23, 2007

(65) Prior Publication Data

US 2009/0101698 A1 Apr. 23, 2009

(51) Int. Cl.
*B65D 25/54* (2006.01)

(52) U.S. Cl. ..... 229/162.2; 40/312; 206/459.5; 206/769; 229/162.7

(58) Field of Classification Search ..... 229/162.1, 229/162.2, 162.7; 206/459.5, 765, 769, 806; 40/312
See application file for complete search history.

(56) References Cited

U.S. PATENT DOCUMENTS 1,784,952 A * 12/1930 Wolfson ..... 40/312
2,126,106 A * 8/1938 Goldberg ..... 206/443
2,245,185 A * 6/1941 Deuble ..... 229/108
3,301,143 A * 1/1967 Palmer ..... 229/162.7
4,378,903 A * 4/1983 Sherwood ..... 229/117.18
5,516,038 A * 5/1996 Zaccarini ..... 229/162.2
7,614,498 B2 * 11/2009 O'Keefe ..... 206/459.5
2005/0241971 A1 * 11/2005 Zou et al. ..... 229/162.1

* cited by examiner

*Primary Examiner*—Gary E Elkins
(74) *Attorney, Agent, or Firm*—Lando & Anastasi, LLP

(57) ABSTRACT

A packing box for headphones has a body. The body has an inner chamber, at least one opening, at least one lid and a window. The opening is defined through the body and communicates with the inner chamber. The lid covers the at least one opening. The window is defined through the body, communicates with the inner chamber and has at least one curved edge. The curved edge displays operational characteristics of the headphones. Potential buyers can quickly discern the operational characteristics of the headphones from the curved edge of the window. Therefore, the correct headphones for buyers' particular needs can be selected quickly and accurately.

11 Claims, 4 Drawing Sheets

PACKING BOX FOR HEADPHONES

BACKGROUND OF THE UTILITY MODEL

1. Field of Utility Model

The present utility model relates to a packing box for headphones, and more particularly to a packing box that holds headphones and displays acoustic characteristics of the headphones to allow buyers to choose conveniently headphones they need.

2. Description of the Related Art

Music that has good fidelity is preferred by listeners. Therefore, headphones having a high signal to noise ratio (SNR) are important and are virtually required. Additionally, various styles of music such as jazz, rock-and-roll, classical music and pop music emphasize different parts of the audible spectrum. For example, rock-and-roll emphasizes low-pitch, and classical music emphasizes high-pitch. Accordingly, headphones must have appropriate frequency responses to reproduce different styles of music so people using the headphones will enjoy undistorted, high sound quality music. Therefore, people should choose headphones appropriate to the music to which they like to listen.

Generally, a set of headphones is packed in a plastic bag or a conventional packing box. The conventional packing box comprises a cardboard box, a headphone-shaped plastic shell liner and an instruction leaflet and allows the headphones and the instruction leaflet to be mounted between the cardboard box and the plastic shell liner. Even though the instruction leaflet provides response characteristics and other information about the headphones, buyers cannot discern the characteristics of the headphones from the appearance of the packing box. Therefore, the buyers may waste money by inadvertently buying inappropriate headphones.

To overcome the shortcomings, the present utility model provides a packing box for earphones to mitigate or obviate the aforementioned.

SUMMARY OF THE UTILITY MODEL

The primary objective of the present utility model is to provide a packing box that holds headphones and displays acoustic characteristics of the headphones to allow buyers to select headphones they need conveniently.

The packing box for headphones in accordance with the present utility model has a body. The body has an inner chamber, at least one opening, at least one lid and a window. The opening is defined through the body and communicates with the inner chamber. The lid covers the at least one opening. The window is defined through the body, communicates with the inner chamber and has at least one curved edge. The curved edge displays operational characteristics of the headphones. Potential buyers can quickly discern the operational characteristics of the headphones from the curved edge of the window. Therefore, the correct headphones for buyers' particular needs can be selected quickly and accurately.

Other objectives, advantages and novel features of the utility model will become more apparent from the following detailed description when taken in conjunction with the accompanying drawings.

DETAILED DESCRIPTION OF THE UTILITY MODEL

Figure 1:
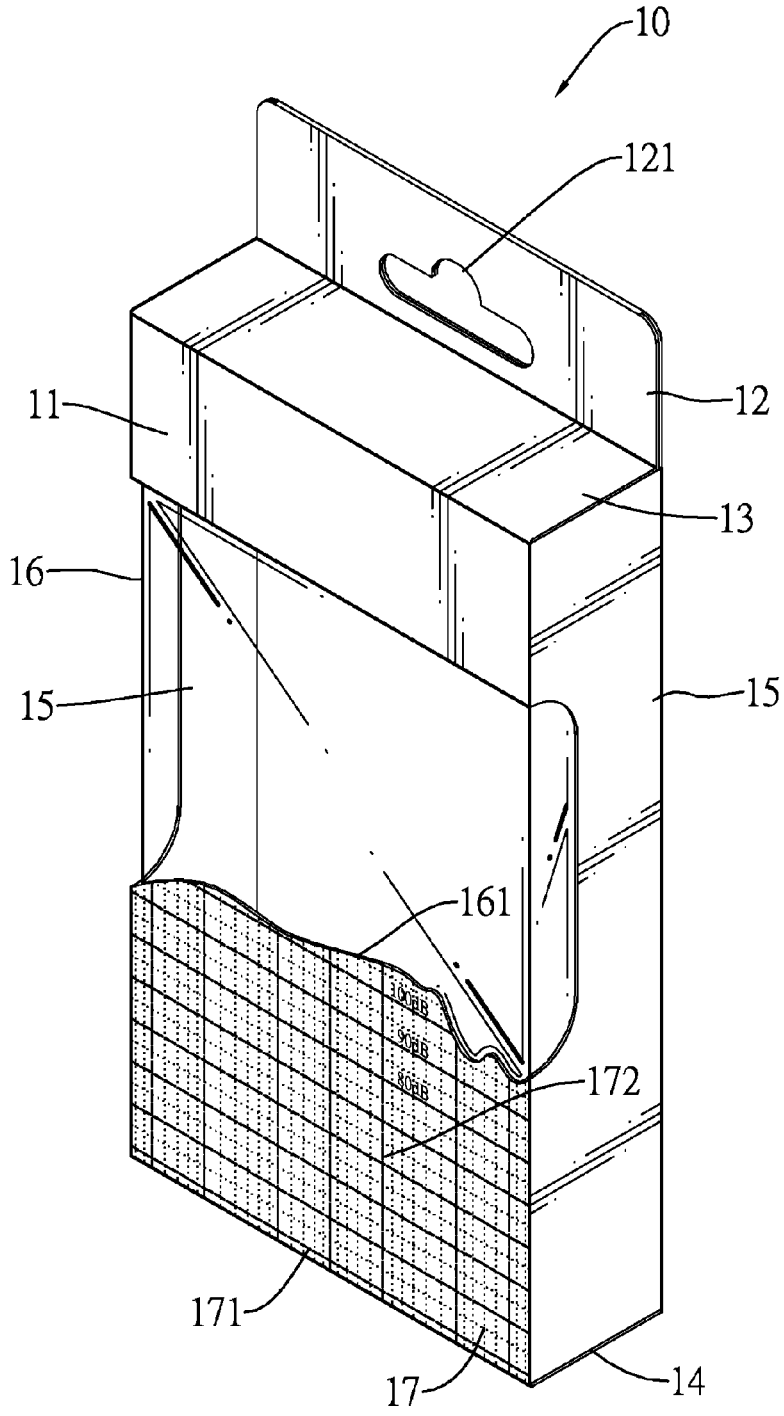
FIG. 1 is a perspective view of a packing box for headphones in accordance with the present utility model.
Figure 2:
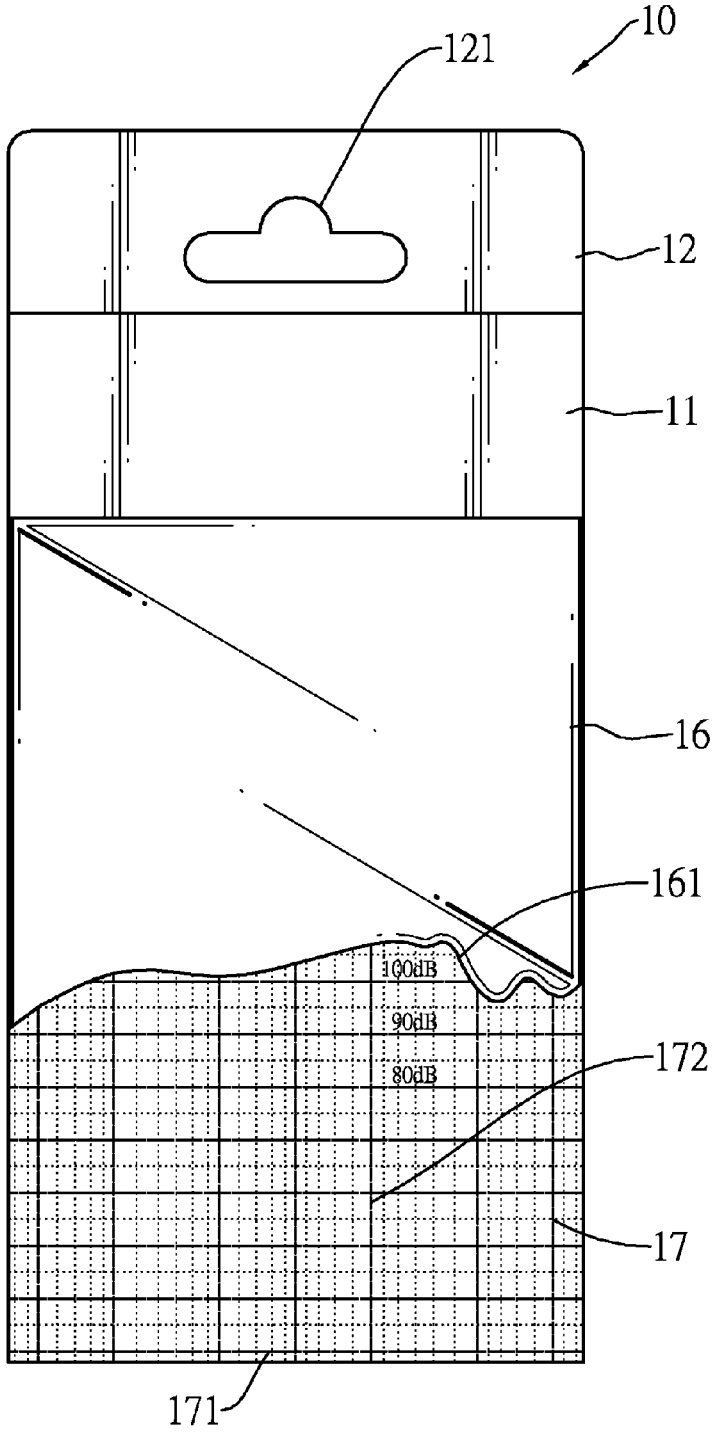
FIG. 2 is a front view of the packing box in FIG. 1.
Figure 3:
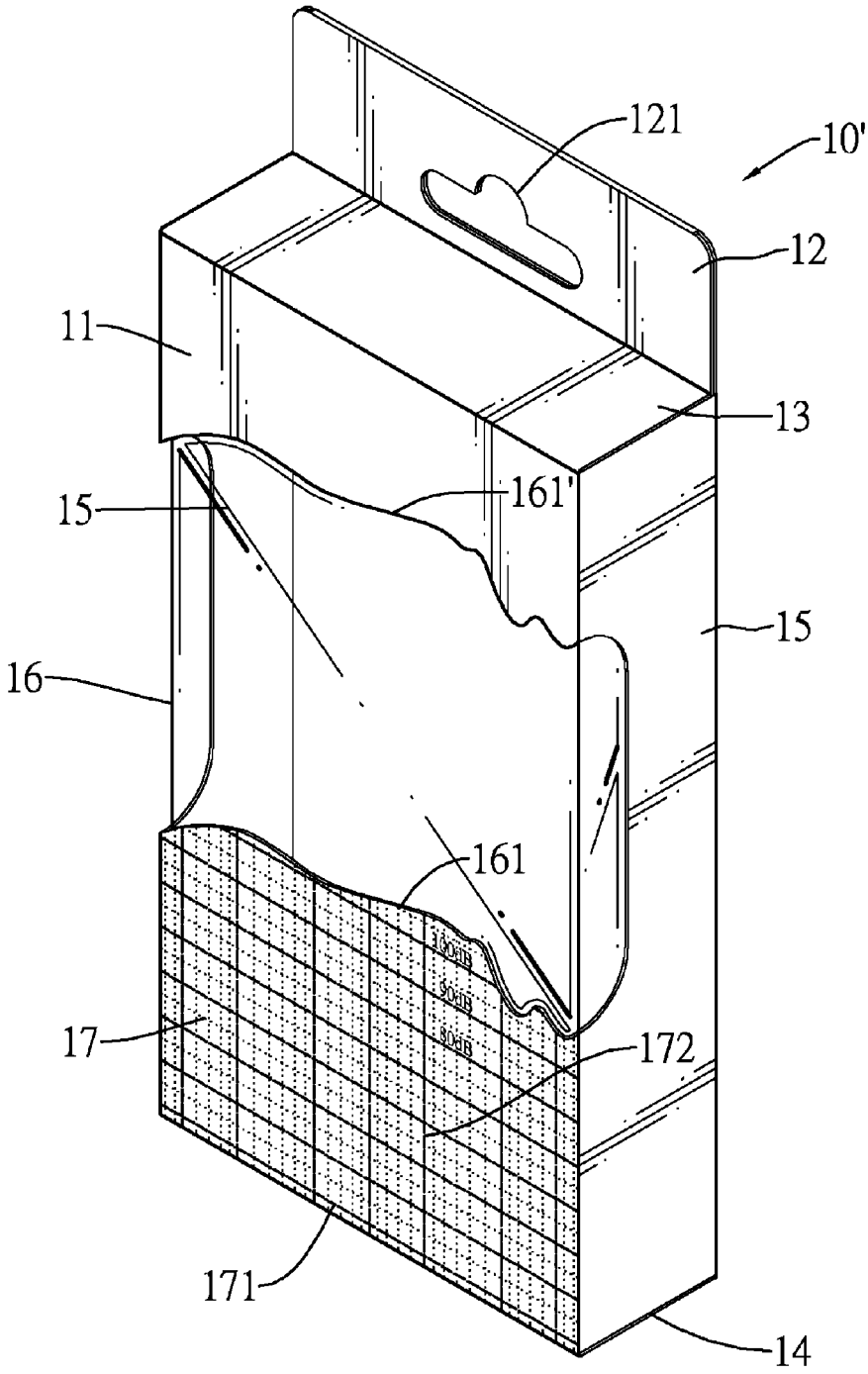
FIG. 3 is a perspective view of a second embodiment of the packing box for headphones in accordance with the present utility model, which has an upper edge of an opening corresponding to a lower edge of the opening.

With reference to FIGS. 1 and 3, a packing box for headphones in accordance with the present utility model has a body (10, 10') and an inner liner.

The body (10, 10') may be a right parallelepiped and has an inner chamber, at least one opening, at least one lid (13), a window (16), a graduated area (17) and a display tab (12). When the body (10, 10') is a right parallelepiped, the body (10, 10') further has a top, a bottom, a front, a rear and two sides.

The inner chamber holds the headphones and may be a right parallelepiped.

The at least one opening is defined through the body (10, 10') and communicates with the inner chamber. When the body (10, 10') has two openings, the openings are defined respectively through the top and the bottom of the body (10, 10').

One lid (13) covers each opening to prevent the headphones from dropping out of the inner chamber of the body (10, 10').

Figure 4:
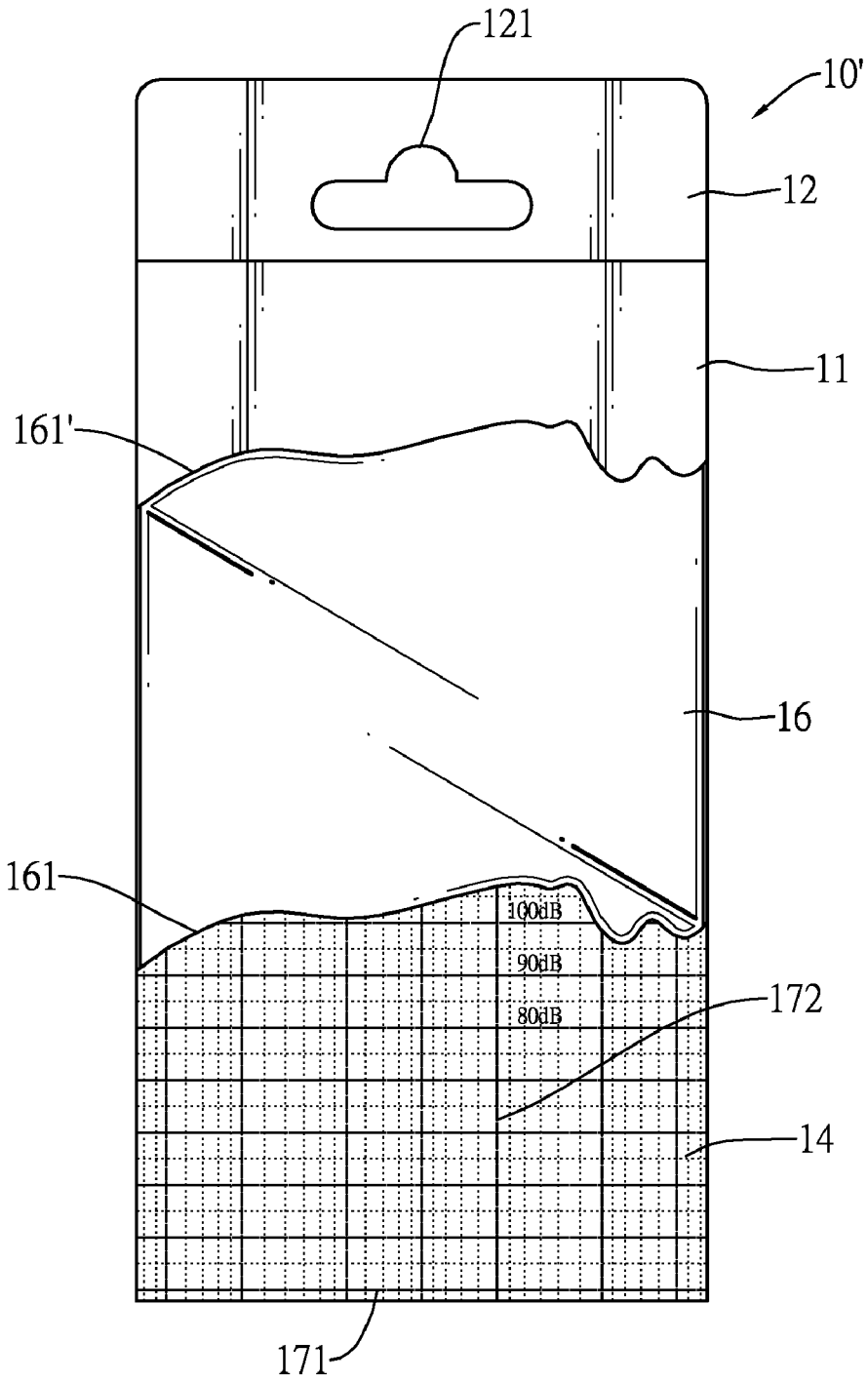
FIG. 4 is a front view of the packing box in FIG. 3.

With further reference to FIGS. 3 and 4, the window (16) may be rectangular, is define through the body (10, 10'), communicates with the inner chamber, may be defined through the front and two sides of the rectangular body (10, 10'), has at least one curved edge and may have a lower edge (161) and an upper edge (161') when the window (16) is rectangular. The at least one curved edge may be the lower edge (161), the upper edge (161') or both to display operational characteristics of the headphones such as frequency response.

The graduated area (17) is formed on the body, may be formed on the front of the rectangular body (10, 10'), may be further formed below the lower edge (161) and has a transverse axis (171) and a vertical axis (172). The transverse axis (171) indicates frequency of sound. The vertical axis (172) indicates signal to noise ratio (SNR in decibels (dB)).

The display tab (12) protrudes from the top of the right parallelepiped body (10, 10'), extends from the rear of the right parallelepiped body (10, 10') and has a mounting hole (121). The mounting hole (121) is defined through the display tab (12) and allows the packing box to be hung up and to display the headphones.

The inner liner is transparent, is made of plastic and is mounted in the inner chamber of the box (10, 10') to hold the headphones.

Potential buyers can quickly discern the operational characteristics of the headphones from the curved edge of the window (16) or even from the graduated area (17). Therefore, the correct headphones for buyers' particular needs can be selected quickly and accurately.

Even though numerous characteristics and advantages of the present utility model have been set forth in the foregoing description, together with details of the structure and function of the utility model, the disclosure is illustrative only. Changes may be made in detail, especially in matters of shape, size and arrangement of parts within the principles of the utility model to the full extent indicated by the broad general meaning of the terms in which the appended claims are expressed.

What is claimed is:

1. A packing box for headphones comprising a body having an inner chamber holding the headphones;

at least one opening being defined through the body and communicating with the inner chamber;

at least one lid covering respectively the at least one opening;

a window being define through the body, communicating with the inner chamber and having at least one curved edge adapted to display operational characteristics of the headphones; and a graduated area being formed on the body and having a transverse axis indicating frequency of sound; and a vertical axis indicating signal to noise ratio (SNR) in decibels (dB).

2. The packing box for headphones as claimed in claim 1, wherein the box is a right parallelepiped and further has a top;

a bottom;

a front;

a rear; and two sides;

the inner chamber is a right parallelepiped;

two openings are defined respectively through the top and the bottom of the body; and the window is defined through the front and two sides of the body.

3. The packing box for headphones as claimed in claim 2, wherein the window is rectangular and further has a lower edge and an upper edge; and the at least one curved edge is the lower edge.

4. The packing box for headphones as claimed in claim 3, wherein the body further has a display tab protruding from the top of the board, extending from the rear of the body and having a mounting hole being defined through the display tab.

5. The packing box for headphones as claimed in claim 2, wherein the window is rectangular and further has a lower edge and an upper edge; and the at least one curved edge is the upper edge of the window.

6. The packing box for headphones as claimed in claim 5, wherein the body further has a display tab protruding from the top of the board, extending from the rear of the body and having a mounting hole being defined through the display tab.

7. The packing box for headphones as claimed in claim 2, wherein the window is rectangular and further has a lower edge and an upper edge; and the at least one curved edge is both the lower edge and the upper edge of the window.

8. The packing box for headphones as claimed in claim 7, wherein the body further has a display tab protruding from the top of the board, extending from the rear of the body and having a mounting hole being defined through the display tab.

9. The packing box for headphones as claimed in claim 2 further has an inner liner being transparent, being made of plastic and being mounted in the inner chamber of the box.

10. The packing box for headphones as claimed in claim 1, wherein the graduated area is formed below the lower edge of the window.

11. The packing box for headphones as claimed in claim 1 further has an inner liner being transparent, being made of plastic and being mounted in the inner chamber of the box.

* * * * *